US006022251A

United States Patent [19]

Ogino

[11] Patent Number: 6,022,251

[45] **Date of Patent: *Feb. 8, 2000**

[54] WATER INLET FOR MARINE DRIVE

[75] Inventor: Hiroshi Ogino, Hamamatsu, Japan

[73] Assignee: Sanshin Kogyo kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/709,168

[22] Filed: Sep. 6, 1996

[30] Foreign Application Priority Data

Sep. 6, 1995 [JP] Japan ..... 7-228961

[51] Int. Cl.[7] ..... B63H 20/28

[52] U.S. Cl. ..... 440/88

[58] Field of Search ..... 440/88, 80, 81, 440/78, 75

[56] References Cited

U.S. PATENT DOCUMENTS

| | | | |
|---|---|---|---|
| 2,021,309 | 11/1935 | Irgens | 440/78 |
| 2,153,626 | 4/1939 | Kissel | 440/88 |
| 3,025,824 | 3/1962 | Foster | 440/88 |
| 3,164,121 | 1/1965 | Alexander, Jr. | 440/88 |
| 3,434,447 | 3/1969 | Christensen et al. . | |
| 3,447,504 | 6/1969 | Shimanckas | 440/75 |
| 3,487,803 | 1/1970 | Alexander, Jr. | 440/88 |
| 3,745,964 | 7/1973 | Henrich . | |
| 3,908,579 | 9/1975 | Miller et al. | 440/88 |
| 4,529,387 | 7/1985 | Brandt . | |
| 4,832,635 | 5/1989 | McCormick | 440/88 |
| 5,766,046 | 6/1998 | Ogino | 440/88 |

FOREIGN PATENT DOCUMENTS

| | | | |
|---|---|---|---|
| 529448 | 8/1956 | Canada | 440/81 |
| 4-60879 | 9/1992 | Japan . | |

*Primary Examiner*—Sherman Basinger
*Attorney, Agent, or Firm*—Knobbe, Martens, Olson & Bear, LLP

[57] ABSTRACT

An outboard drive is equipped with a water inlet located on a lower casing of the outboard drive. The lower casing includes a nacelle that houses a transmission and a propulsion shaft that are coupled to an engine through a drive train. The propulsion shaft rotates about a longitudinal axis that is aligned with a centerline of the nacelle. The water inlet is located on a front, cone-shaped nose of the nacelle, forward of the transmission and above the longitudinal axis of the of the propulsion shaft. The water inlet communicates with a water passage that guides cooling water to a water pump. The water passage is located in front of the transmission in order to increase the size of the water passage over prior water cooling systems of outboard drives.

22 Claims, 9 Drawing Sheets

WATER INLET FOR MARINE DRIVE

BACKGROUND OF THE INVENTION

1. Field of the Invention

The present invention relates to a marine drive, and in particular to a water cooling system for a marine drive.

2. Description of the Related Art

An outboard motor commonly employs a water cooling system to cool an engine of the marine drive. The cooling system draws water from the body of water in which the watercraft is operated. For this purpose, a water inlet of the cooling system often is located on a lower unit of the outboard motor. The water inlet desirably is submerged beneath the water at all times when the watercraft is in the body of water. A pump draws water through the inlet and a water passage within the lower unit and delivers the water to cooling jackets within the engine.

The water inlet and the associated water passage of prior outboard motors commonly lies on the side of the lower unit well above a nacelle of the lower unit which houses a transmission and propeller shafts. This prior location of the water inlet and water passage, however, poses several drawbacks. For instance, the water passage tends not to have a sufficient size to provide an abundant supply of water to the pump. Little room exists on the side of the lower unit for the passage. The size of the water passage also has tended to be sacrificed in prior outboard motor designs in order to increase the size of an exhaust passage through the lower unit.

The position of the water inlet also poses a problem when the outboard motor is mounted in a high position on the transom of the watercraft so as to run the propellers partially exposed. Under some mounting arrangements, the water inlet can lie either at or above the surface of the water when the watercraft is up on plane. The amount of water forced or drawn into the water inlet consequently decreases from its submerged position. This effect of course exacerbates the problem of providing an ample supply of water to the water pump.

SUMMARY OF THE INVENTION

A need therefore exists for an improved water cooling system for an outboard drive which provides an ample supply of water to a water pump located above the water inlet.

One aspect of the present invention thus involves an outboard drive for a marine propulsion system which includes an engine. The outboard drive includes a lower casing which houses a transmission that the engine drives. The transmission selectively couples the engine to a propulsion device which the lower casing supports. A water cooling system supplies cooling water to the engine. A water inlet of the cooling system receives water which flows into a water passage. The water passage guides the water to a water pump. The water passage is positioned on the front side of the transmission. In this position, the size of the water passage can be increased without increasing the width of the lower unit and without affecting with the size of the exhaust discharge passage through the lower casing.

Another aspect of the present invention involves an outboard drive for a marine propulsion system which includes an engine. The outboard drive comprises a lower casing housing a transmission that is driven by the engine. The transmission selectively couples the engine to a propulsion device which the lower casing supports. A water cooling system supplies cooling water to the engine. A water inlet of the cooling system is positioned on the lower casing directly in front of the transmission.

In accordance with another aspect of the present invention, an outboard drive is coupled with an engine. The outboard drive includes a lower casing having a nacelle. The nacelle has a bullet-shaped nose and house a transmission and at least one propulsion shaft that rotates about a longitudinal axis to drive a propulsion device. The propulsion shaft is arranged within the nacelle such that a centerline of the nacelle lies parallel to the longitudinal axis. A water inlet of a water cooling system is located on the nose of the nacelle immediately above the longitudinal axis of the propulsion shaft.

An additional aspect of the present invention involves a watercraft equipped with an engine that is coupled to an outboard drive. The watercraft has a hull with a bottom surface and a transom. The outboard drive includes a lower casing which supports a propulsion device at a rear end of the lower casing. The outboard drive is mounted on the transom in a position relative to the bottom surface where the propulsion device is intended to operate at partially exposed above the surface of the body of water in which the watercraft is operated when the watercraft is up on plane. The outboard drive includes a water inlet for a water cooling system that supplies cooling water to the engine. The water inlet is positioned on the lower casing in a position which lies beneath the water surface when the watercraft is up on plane.

DESCRIPTION OF THE DRAWINGS

These and other features of the invention will now be described with reference to the drawings of preferred embodiments of the present outboard drive. The illustrated embodiments of the outboard drive are intended to illustrate, but not to limit the invention. The drawings contain the following figures.

DETAILED DESCRIPTION OF THE PREFERRED EMBODIMENTS

Figure 1:
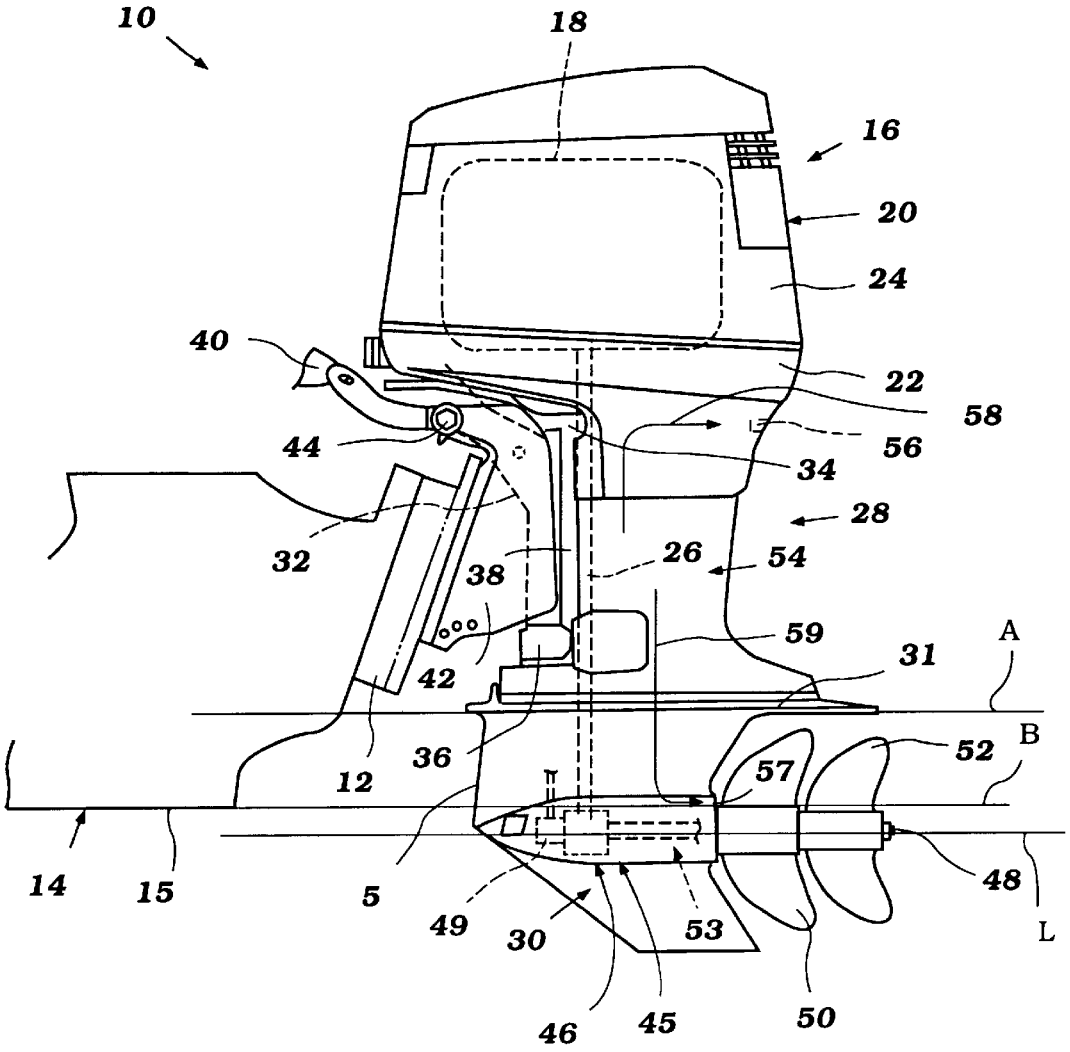
FIG. 1 is a side elevational view of an outboard motor which incorporates a water cooling system that is configured in accordance with a preferred embodiment of the present invention.

FIG. 1 illustrates an outboard drive 10 configured in accordance with the preferred embodiment of the present invention. In the illustrated embodiment, the outboard drive 10 is depicted as an outboard motor for mounting on a transom 12 of the watercraft 14 having a bottom surface 15. It is contemplated, however, that those skilled in the art will readily appreciate that the present invention can be applied to stern drive units of inboard/outboard motors, and to other types of watercraft drive units, as well. Thus, as used herein, "outboard drive" generically means an outboard motor, a stern drives, and similar marine drive units. Additionally, "front" and "rear" are used herein in reference to the transom 12 of the watercraft 14.

In the illustrated embodiment, the outboard motor 10 has a power head 16 which desirably includes an internal combustion engine 18. The internal combustion engine 18 can have any number of cylinders and cylinder arrangements, and can operate on a variety of known combustion principles (e.g., on a two-stroke or a four-stroke principle).

A protective cowling assembly 20 surrounds the engine 18. The cowling assembly 20 includes a lower tray 22 and a top cowling 24. The tray 22 and the cowling 24 together define a compartment which houses the engine 18 with the lower tray 22 encircling a lower portion of the engine 18.

The engine 18 is mounted conventionally with its output shaft (i.e., a crankshaft) rotating about a generally vertical axis. The crankshaft (not shown) drives a drive shaft 26, as known in the art. The drive shaft 26 depends from the power head 16 of the outboard motor 10.

A drive shaft housing 28 extends downwardly from the lower tray 20 and terminates in a lower unit 30. A plate 31 extends horizontally outward at the junction between the drive shaft housing 28 and the lower unit 30. The drive shaft 26 extends through the drive shaft housing 28 and is suitably journaled therein for rotation about the vertical axis.

A conventional steering shaft assembly 32 is affixed to the drive shaft housing 28 by upper and lower brackets 34, 36. The brackets 34, 36 support the steering shaft assembly 32 for steering movement. Steering movement occurs about a generally vertical steering axis which extends through a steering shaft 38 of the steering shaft assembly 32. A steering arm 40, which is connected to an upper end of the steering shaft 38, can extend in a forward direction for manual steering of the outboard motor 10, as known in the art.

The steering shaft assembly 32 also is pivotably connected to a clamping bracket 42 by a pin 44. This convention coupling permits the outboard motor 10 to be pivoted relative to the pin 44 to permit adjustment of the trim position of the outboard motor 10 and for tiltup of the outboard motor 10.

Although not illustrated, it is understood that a conventional hydraulic tilt-and-trim cylinder assembly, as well as a conventional steering cylinder assembly, can be used as well with the present outboard motor 10. The construction of the steering and trim mechanisms is considered to be conventional, and for that reason, further description is not believed necessary for an appreciation or understanding of the present invention.

Figure 2:
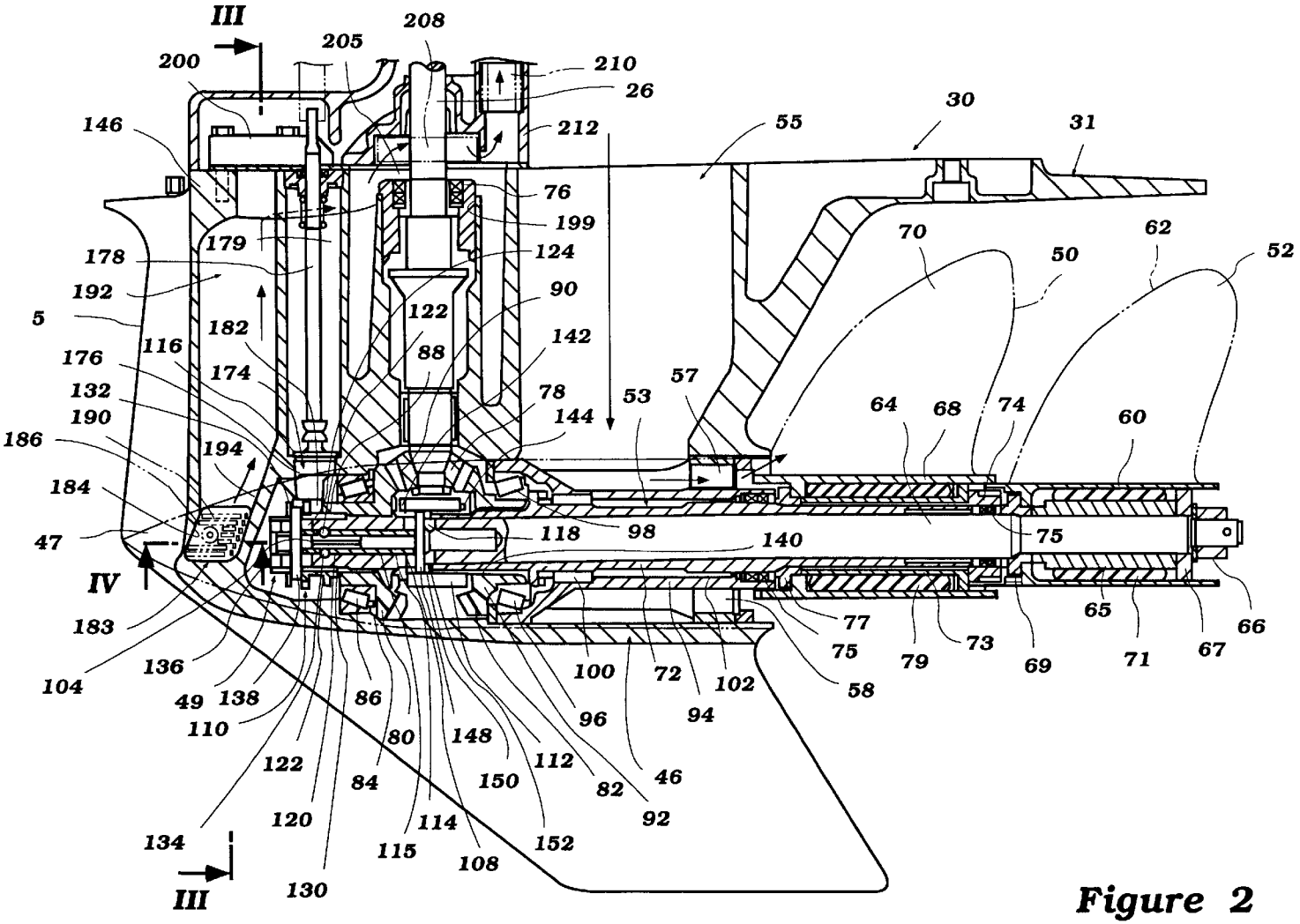
FIG. 2 is a sectional, side elevational view of a lower unit of the outboard motor of FIG. 1 illustrating the water cooling system, transmission and a propulsion device of the outboard motor which includes a propulsion shaft assembly.

With reference to FIGS. 1 and 2, the drive shaft 26 continues from the drive shaft housing 28 into the lower unit 30, where it drives a transmission 45. The lower unit includes a nacelle 46, which houses the transmission 45, and a strut 5. The strut depends downward from the drive shaft housing 28. The nose 47 of the nacelle is desirably shaped so as to be substantially streamlined. For instance, the nose 47 may be cone-shaped or it may have a rounded front end that tapers in the forward direction.

The transmission 45 selectively establishes a driving condition of a propulsion device 48, which can take the form of a propeller, a hydrodynamic jet, or like propulsion device. A shift mechanism 49, housed within the nacelle 46, advantageously operates the transmission 45 in forward/neutral/reverse states. In this manner, the propulsion device 48 can drive the watercraft 14 in any of these three operational states.

The present transmission 45 is particularly well suited for use with a counter-rotating propulsion device 48. The counter-rotating propulsion device 48, which is illustrated in FIGS. 1 and 2, includes a front propeller 50 designed to spin in one direction and to assert a forward thrust, and a rear propeller 52 which is designed to spin in an opposite direction and to assert a forward thrust. The propellers 50, 52 thus are of opposite hand and rotate about a propulsion shaft 53 having a longitudinal axis L. The longitudinal axis L desirably lies along the centerline of the nacelle 46. The construction of the propellers will be described below.

An exhaust system discharges engine exhaust from an engine manifold of the engine 18. The engine manifold of the engine 18 communicates with an exhaust conduit formed within an exhaust guide positioned at the upper end of the drive shaft housing 28. The exhaust conduit of the exhaust guide opens into an expansion chamber 54. The expansion chamber 54 is formed within the drive shaft housing 28 and communications with a discharge conduit 55 (see FIG. 2) formed within the lower unit 30. The expansion chamber 54 also communicates with an upper exhaust outlet 56. The discharge conduit 55 terminates with a discharge end 57 formed on the rear side of the lower unit 30. In this manner, engine exhaust flows 58 and 59 are discharged into the air through the upper exhaust outlet 56 or into the water through discharge end 57.

FIG. 2 illustrates the components of the front and rear propellers 50, 52. The rear propeller includes a hub 60 to which propeller blades 62 are integrally attached. An inner propulsion shaft 64 drives the rear propeller hub 60. For this purpose, the rear end of the inner propulsion shaft 64 carries an engagement sleeve 65 which has a spline connection with the rear end of the rear propulsion shaft 64. The sleeve 65 is fixed to the rear end of the inner shaft 64 by nut 66 threaded on the rear end of the shaft 64, securing the sleeve between a washer 67 and a rear thrust washer 69 positioned between the front and rear propeller 50, 52.

An elastic bushing 71 is interposed between the engagement sleeve 65 and the rear propeller hub 60 and is compressed therebetween. The bushing 71 is secured to the engagement sleeve 65 by a heat process known in the art.

The frictional engagement between the hub 60 and the elastic bushing 71 is sufficient to transmit rotational forces from the engagement sleeve 65, driven by the inner propulsion shaft 64 to the rear propeller blades 52. The bushing 71 provides vibrational damping between the drive shaft 64 and the propeller hub 60.

The front propeller 50 likewise includes a propeller hub 68. Propeller blades 70 are integrally formed on the exterior of the hub 68.

An outer propulsion shaft 72 carries the front propeller 50. As best seen in FIG. 2, the rear end portion of the outer propulsion shaft 72 carries a front engagement sleeve 73 and drives the engagement sleeve 73 thereabouts by a spline connection. The front engagement sleeve 73 is secured onto the outer propulsion shaft between an annular retaining ring 74 and a front thrust valve 77. Seals 75 are located on the front and rear sides of the front propeller hub 68.

A front annular elastic bushing 79 surrounds the front engagement sleeve 73. The bushing 79 is secured to the sleeve 73 by a heat process known in the art.

The front propeller hub 68 surrounds the elastic bushing 79, which is held under pressure between the hub 68 and the engagement sleeve 73 in frictional engagement. The frictional engagement between the propeller hub 68 and the bushing 79 is sufficient to transmit a rotational force from the sleeve 73 to the propeller blades 50 of the front propeller hub 68. Again, the elastic bushing 79 affords vibrational damping between the outer propulsion shaft 72 and the front propeller hub 68.

In the illustrated embodiment, the outer propulsion shaft 72 has a tubular shape. The inner propulsion shaft 64 extends through the outer propulsion shaft 74. The shafts 64, 72 desirably are coaxial and rotate about a common longitudinal axis L.

The individual components of the present transmission 45 will now be described in detail with reference to FIGS. 2. As seen in FIG. 2, the lower end of the drive shaft 26 is suitably journaled within the lower unit 30 by a pair of bearing assemblies 76. At its lower end, the drive shaft 26 carries a drive gear or pinion 78 which forms a portion of the transmission 45. The pinion 78 preferably is a bevel-type gear.

The transmission 45 also includes a pair of counter-rotating driven gears 80, 82 that are in mesh engagement with the pinion 78. The pair of driven gears 80, 82 preferably are positioned on diametrically opposite sides of the pinion 78, and are suitably journaled within the lower unit 30, as described below. Each driven gear 80, 82 is positioned at about a 90° shaft angle with the drive shaft 26. That is, the propulsion shafts 68, 72 and the drive shaft 26 desirably intersect at about a 90° shaft angle; however, it is contemplated that the drive shaft 26 and the propulsion shafts 64, 72 can intersect at almost any angle.

In the illustrated embodiment, the pair of driven gears 80, 82 are a front bevel gear 80 and an opposing rear bevel gear 82. The front bevel gear includes a hub 84 which is journaled within the lower unit 30 by a front thrust bearing 86. The thrust bearing 86 rotatably supports the front gear 80 in mesh engagement with the pinion 78.

As seen in FIG. 2, the hub 84 has a center bore through which the inner propulsion shaft 64 passes. The inner propulsion shaft 64 is suitably journaled within the central bore of the front gear hub 84.

The front gear 80 also includes a series of teeth 88 on an annular front-facing engagement surface, and includes a series of teeth 90 on an annular rear-facing engagement surface. The teeth 88, 90 on each surface positively engage a portion of a clutch of the transmission 45, as described below.

The rear gear 82 also includes a hub 92 which is suitably journaled within a bearing carrier 94 by a rear thrust bearing 96. The rear thrust bearing rotatably supports the rear gear 82 in mesh engagement with the pinion 78.

The hub 92 of the rear gear 82 has a central bore through which the inner propulsion shaft 64 and the outer propulsion shaft 72 pass. The rear gear 82 also includes an annular front engagement surface which carries a series of teeth 98 for positive engagement with a clutch of the transmission 45, as described below.

As best seen in FIG. 2, the bearing carrier 94 rotatably supports the hollow outer propulsion shaft 72 within the lower unit 30. A front needle bearing 100 journals the front end of the outer propulsion shaft 72 within the bearing carrier 94. A rear needle bearing 102 supports the outer propulsion shaft 72 within the bearing carrier 94 at an opposite end of the bearing carrier 94 from the front needle bearing 100.

As best seen in FIG. 2, the inner propulsion shaft 64 extends through the front gear hub 84 and the rear gear hub 92 and is suitable journaled therein. On the rear side of the rear gear 82, the inner propulsion shaft 64 extends through the outer propulsion shaft 72 and is suitable journaled therein.

As seen in FIG. 2, the front end of the inner propulsion shaft 64 includes a longitudinal bore 104. The bore 104 extends from the front end of the inner shaft 64 to a point within the hub 92 of the rear gear 82. The longitudinal bore 104 communicates with lubricant passages within the inner shaft 64 positioned at the rear end of the longitudinal bore 104. A front aperture 106 extends through the inner shaft 64, transverse to the axis of the longitudinal bore 104, at a position forward of the front bevel gear 80. The inner shaft 64 also includes a rear aperture 108 that extends transversely to the longitudinal axis L of the inner shaft and is generally symmetrically positioned between the front bevel gear 80 and the rear bevel gear 82.

As seen in FIG. 2, the transmission 45 also includes a front clutch 110 and a rear clutch 112 coupled to a plunger 114. As discussed in detail below, the front clutch 110 couples the inner propulsion shaft 64 to the front gear 80. The rear clutch 112 selectively couples the outer propulsion shaft 72 either to the front gear 80 or to the rear gear 82. FIG. 2 illustrates the front clutch 110 and the rear clutch 112 set in a neutral position (i.e., in a position in which the clutches 110, 112 do not engage either the front gear 80 or the rear gear 82). In the illustrated embodiment, the clutches 110, 112 are positive clutches, such as, for example, dog clutch sleeves; however, it is contemplated that the present transmission 45 could be designed with friction-type clutches.

The plunger 114 includes a generally cylindrical rod-shape body 115 and slides within the longitudinal bore 104 of the inner shaft 64 to actuate the clutches 110, 112. The plunger 114 desirably is hollow (i.e., is a cylindrical tube).

The plunger 114 includes a front hole 116 that is positioned generally transverse to the longitudinal axis of the plunger 114 and a rear slot 118 that is likewise positioned generally transverse to the longitudinal axis of the plunger 114. The hole 116 and the slot 118 desirably are each located symmetrically in relation to the corresponding apertures 106, 108 of the inner propulsion shaft 64, with the plunger 114 set in the neutral position.

The transmission 45 also includes a neutral detent mechanism 120 to hold the plunger 114 (and the coupled clutches 110, 112) in the neutral position. The neutral detent mechanism 120 operates between the plunger 114 and the inner propulsion shaft 64, and is located toward the front end of the inner propulsion shaft 64.

As best seen in FIG. 2, the neutral detent mechanism is formed in part by at least one and preferably two transversely positioned holes in the plunger 114. These holes receive detent balls 122. The detent balls 122 each have a diameter which is slightly smaller than the diameter of each hole.

The inner propulsion shaft 64 includes an annular groove 124 which is formed on the inner wall of the bore 104 through which the plunger 114 slides. The groove 124 is positioned within the bore 104 so as to properly locate the clutches 110, 112 in the neutral position when the detent holes of the plunger 114 coincide with the axial position of the annular groove 124. A spring plunger 126, formed in part by a helical compression spring, biases the detent balls 122 radially outwardly against the inner wall of the inner propulsion shaft bore 104. The plunger 114 contains the spring plunger 126 within its tubular body 115.

The spring plunger 126 forces portions of the detent balls 122 into the annular groove 124 when the plunger 114 is moved into the neutral position. This releasable engagement between the detent balls 122 carried by the plunger 114 and the annular groove 124 of the inner propulsion shaft 64 releasably restrains movement of the plunger 114 relative to the inner propulsion shaft 64, as known in the art. Because the detent mechanism 120 is believed to be conventional, further description of the detent mechanism 120 is thought unnecessary for an understanding of the present transmission 45.

As seen in FIG. 2, the front dog clutch 110 has a generally cylindrical shape that includes an axial bore. The bore extends through an annular front end and a flat annular rear end of the clutch 110. The bore is sized to receive the inner propulsion shaft 64. Internal splines are formed on the wall of the axial bore. The internal splines mate with external spines formed on the front end of the inner propulsion shaft 64. The resulting spline connection establishes a driving connection between the front clutch 110 to the inner propulsion shaft 64, while permits the clutch 110 to slide along the front end of shaft 110.

The annular rear end surface of the clutch 110 lies generally transverse to the longitudinal axis L of the inner propulsion shaft 64. The rear surface of the front dog clutch 110 also is substantially coextensive in the area with the annular front surface of the front gear 80. Teeth 130 extend from the clutch rear surface in the longitudinal direction and desirably corresponds with the teeth 88 on the front surface of the front driven gear 80, both in size (i.e., axial length), in number, and in configuration.

A pair of annular grooves circumscribe the exterior of the front clutch 110. A front groove 132 is sized to receive a retaining spring, as described below. The rear groove 134 is sized to cooperate with an actuator mechanism, which will be described below.

The front clutch also includes a traverse hole 136 that extends through the clutch 110 at the location of the front annular groove 132. The hole 136 is sized to receive a pin 138 which, when passed through the front aperture 106 of the inner propulsion shaft 64 and through the front hole 116 of the plunger 114, interconnects the plunger 114 and the front clutch 110 with the front clutch 110 positioned on the inner propulsion shaft 64. The pin 138 may be held in place by a press-fit connection between the pin 138 and the front hole 136, or by a conventional coil spring (not shown) which is contained within the front annular groove 132 about the exterior of the front clutch 110.

The rear clutch 112 is disposed between the two counter-rotating driven gears 80, 82. The rear clutch 112 has a tubular shape that includes an axial bore 140 which extends between an annular front end and an annular rear end. The bore 140 is sized to receive a portion of the outer propulsion shaft 72, which is positioned about the inner propulsion shaft 64.

The annular end surfaces of the rear clutch 112 are substantially coextensive in size with the annular engagement surfaces of the front and rear gears 80, 82, respectively. Teeth 142 extend from the front end of the rear clutch 112 and desirably correspond to the respective teeth 90 of the front gear 80 in size (e.g., axial length), in number, and in configuration. Teeth 144 likewise extend from the rear end surface of the rear clutch 112 and desirably correspond to the respective teeth 98 of the rear gear 82 in size (e.g., axial length), in number, and in configuration.

The front engagement end of the rear clutch 112 advantageously carries a greater number of teeth 142 than the rear engagement end of the rear clutch 112 and a greater number teeth than the front clutch 110. In the illustrated embodiment, the front clutch 110 and the rear engagement end of the rear clutch 112 desirably include the same number of clutching teeth 130, 144, respectively. The front engagement end of the rear clutch 112 desirably includes twice as many teeth 142 as the number of teeth on the rear engagement end of the rear clutch 112. In this manner, the torque load per tooth 142 when the rear clutch 112 engages the front gear 80 is about the same as the torque load per tooth 130, 144 when the front clutch 110 engages the front gear 80 and the rear clutch 112 engages the rear gear 82, even though the entire torque transmitted by the drive shaft 26 is being transmitted to the outer propulsion shaft 72 through the rear clutch 112. In addition, the fewer number of teeth involved where the clutches 110, 112 simultaneously engage the gears 80, 82 eases shifting, because registration between the corresponding teeth is achieved quicker.

A spline connection couples the rear clutch 112 to the outer propulsion shaft 72. The clutch 112 thus drives the outer propulsion shaft 72 through the spline connection, yet the clutch 112 can slide along the front end of the shaft 72 between the front and rear gears 80, 82.

As seen in FIG. 2, the rear clutch 112 also includes a counterbore. The counterbore is sized to receive a coupling pin 148 which extends through the rear aperture 108 of the inner propulsion shaft 64 and through the rear slot 118 of the plunger 114. The pin 148 has a diameter smaller than the length of the slot 118. In the illustrated embodiment, the diameter of the pin 148 is about half that of the length of the slot 118.

The ends of the pin 148 desirably are captured by an annular bushing 150 which is interposed between a pair of roller bearings. The assembly of the bushings and bearings is captured between a pair of washers and locked within the counterbore of the rear dog clutch 118 by a retainer ring 152. The roller bearings journal the assembly of the bushing 150 and the pin 148 within the counterbore to allow the bushing 150 and the pin 148 to rotate in an opposite direction from the rear clutch 112. The pin 148, being captured within the counterbore of the rear clutch 112, however, couples the plunger 114 to the rear clutch 112 in order for the plunger 114 to actuate the rear clutch 112.

With reference to FIG. 2, an actuator mechanism 174 moves the plunger 114 of the clutch assembly from a position establishing a forward drive condition, in which the front and rear clutches 110, 112 engage the front and rear gears 80, 82, respectively, through a position of non-engagement (i.e., the neutral position), and to a position establishing a reverse drive condition, in which the rear clutch 112 engages the front gear 110. The actuator mechanism 174 positively reciprocates the plunger 114 between these positions.

The actuator mechanism 174 includes a cam member 176 that connects the front clutch 110 to a rotatable shift rod 178, which is housed within a sealed vertical chamber 179 within the lower unit 30. In the illustrated embodiment, the shift rod 178 is journaled for rotation in the lower unit 30 and extends upwardly to a transmission actuator mechanism (not shown) positioned within the outboard motor cowling 20. The actuator mechanism 174 converts rotational movement of the shift rod 178 into linear movement of the front clutch 110 to move the front clutch 110, as well as the plunger 114 and the rear clutch 112, along the axis L of the propulsion shafts 64, 72. The shift rod 178 lies closer to the drive shaft 26 than to a leading edge of the lower unit 30.

The cam member 176 is affixed to a lower end of the shift rod 178. The cam member 176 includes an eccentrically positioned drive pin (not shown) which extends downwardly from the cam member 176. The cam member also includes a cylindrical upper portion which is positioned to rotate about the axis of the shift rod 178 and is journaled within the lower unit 30.

A follower 182 of the actuator mechanism generally has a rectangular block-like shape with a retention arm (not shown) depending from one end. The retention arm advantageously depends from the leading edge of the follower 182 relative to the designed rotation of the clutch 110. The retention arm holds the follower 182 on the clutch with the follower 182 captured between the clutch 110 in the rear groove 134 and the lower end of the cam member 176.

The follower 182 also includes a slot which is formed on the upper side of the following member. The slot has a width generally equal to the diameter of the drive pin of the cam member 176. The drive pin extends into the slot of the follower 182 and is captured between the walls of the follower 182.

The follower 182 has a width generally equal to the width of the rear annular groove 134 of the front clutch 110. The height of the follower 182 also generally matches the distance between the lower end of the cam member 176 and the base of the rear groove 134. In this matter, the rear groove 134 receives and captures the follower 182 of the actuator mechanism 174.

The drive pin of the cam member 176 moves both axially and transversely with rotation of the cam member 176 because of the eccentric position of the drive pin relative to the rotational axis of the cam member 176. The aperture of the follower 182 thus desirably has a sufficient length to accommodate the transverse travel of the drive pin as the cam member 176 rotates between positions corresponding to the forward and reverse drive conditions. The axial travel of the drive pin causes the follower 182 and the coupled clutch 110 to move axially, sliding over the inner propulsion shaft 64, as discussed in detail below.

The front clutch 110 thus is coupled to the cam member 176 with the follower 182 cradled between the walls of the rear annual groove 134 on the front clutch 110. The actuator mechanism 74 configured accordingly positively moves the front clutch 110 along the axis of the inner propulsion shaft 64 with rotational movement of the cam member 176 operated by the shift rod 178. The coupling between the actuator mechanism 174 and the front clutch 110, however, allows the front clutch 110 to rotate with the inner propulsion shaft 64 relative to the follower 182 and the cam member 176.

As noted above, the pin 138 connects the front clutch 110 to the plunger 114. This coupling causes the plunger 114 to rotate with the front clutch 110 and the inner propulsion shaft 64. The coupling also conveys the axial movement of the clutch 110 driven by the actuator mechanism 174 to the plunger 114. The plunger 114 consequently moves the rear clutch 112 which travels with the plunger 114.

FIG. 2 illustrates the front and rear clutches 110, 112 in the neutral position, i.e., a position of non-engagement with the gears 80, 82. The detent mechanism 120 maintains the plunger 114 and the coupled clutches 110, 112 in this position.

To establish a forward drive condition, the shift rod 178 rotates the cam member 176 in a manner which moves the drive pin of the cam member 176 axially in the reverse direction. In the illustrated embodiment, clockwise rotation of the shift rod 178 moves the drive pin axially in the rearward direction. The follower 182 thus follows the drive pin to slide the front clutch 110 over the inner propulsion shaft 64. The actuator mechanism 174 thereby forces the front clutch 110 into engagement with the front gear 80, with the corresponding clutch teeth 88, 130 mating. So engaged, the front gear 80 drives the inner propulsion shaft 64 through the internal spline connection between the clutch 110 and the inner propulsion shaft 64. The inner propulsion shaft 64 thus drives the rear propeller 52 in a first direction which asserts a forward thrust.

The forward motion of the clutch 110 also causes the plunger 114 to slide within the longitudinal bore 108 of the inner propulsion shaft in the reverse direction due to the direct coupling of the drive pin 138. The plunger 114 moves the rear coupling pin 148 in the rearward direction to force the rear clutch 112 into engagement with the rear gear 82 with the corresponding teeth 98, 144 mating.

Once the teeth 144 of the rear clutch 112 register with the teeth 98 of the rear gear 82, the rear clutch 112 engages with the rear gear 82. So engaged, the rear gear 82 drives the outer propulsion shaft 72 through the spline connection between the rear clutch 112 and the outer propulsion shaft 72. The outer propulsion shaft 72 thus drives the front propeller 50 (FIG. 2) to spin in an opposite direction to that of the rear propeller 52 and to assert a forward thrust.

To establish a reverse drive condition, the shift rod 178 rotates in an opposite direction so as to move the cam member 176 and the eccentrically positioned drive pin in a direction which moves the drive pin axially in the forward direction. Again, in the illustrated embodiment, clockwise rotation of the shift rod 178 rotates the drive pin so as to move the drive pin axially in the forward direction. The forward movement of the drive pin is transferred to the front clutch 110 through the follower 182. This motion also is transferred to the plunger 114 through the clutch 110 and the corresponding coupling pin 138. The forward motion of the plunger 114 positively forces the rear clutch 112 into engagement with the front gear 80 with the corresponding clutching teeth 90, 142 mating.

Once the corresponding teeth 142, 90 of the rear clutch 112 and front gear 80 register, the front gear 80 and rear clutch 112 engage. So engaged, the front gear 80 drives 10 the outer propulsion shaft 72 through the spline connection between the rear clutch 112 and the outer propulsion shaft 72. The outer propulsion shaft 72 thus drives the front propeller 50 (FIG. 2) in a direction which asserts a reverse thrust to propel the watercraft 14 in reverse.

Figure 3:
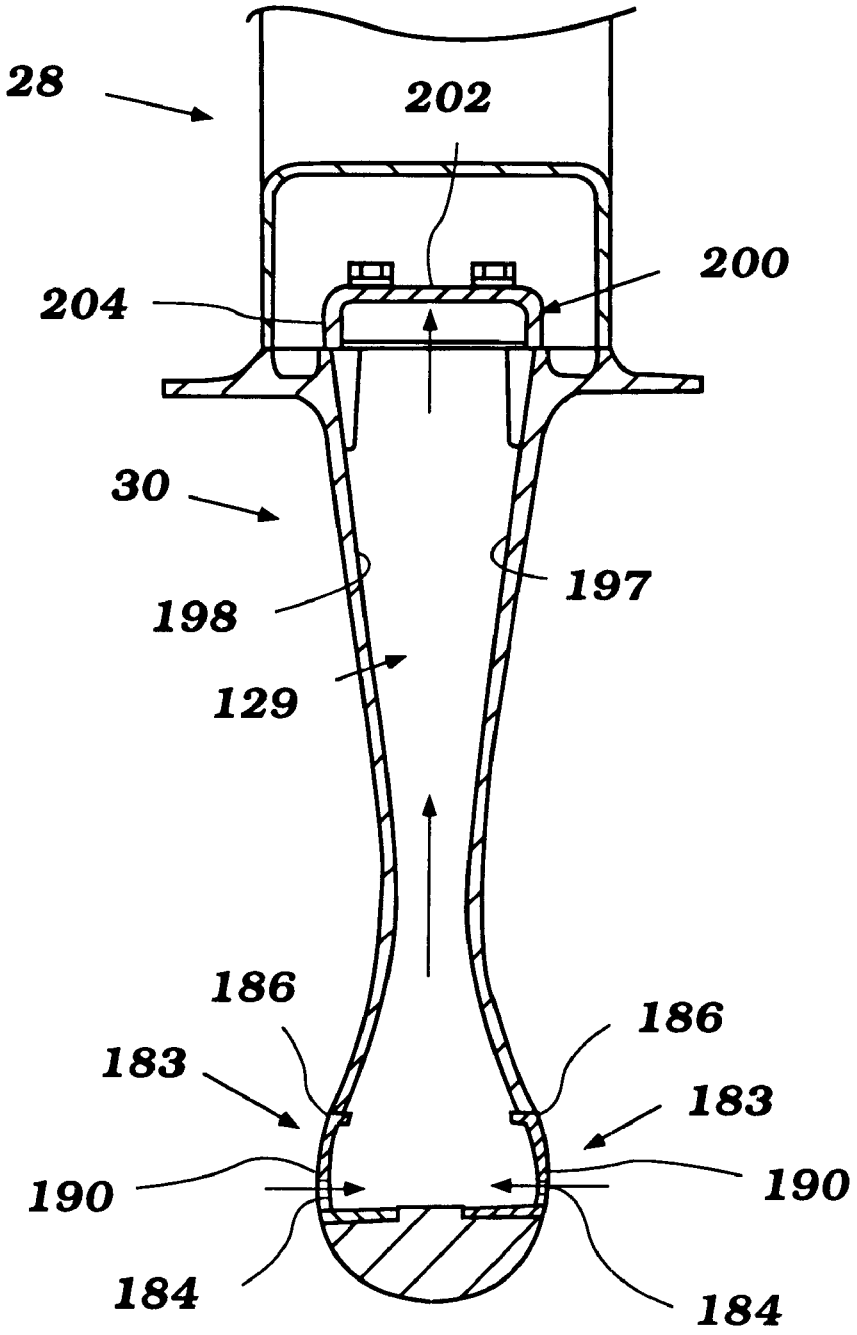
FIG. 3 is a front plan view of the lower unit of the outboard motor of FIG. 1 taken along the lines III—III in FIG. 2.
Figure 4:
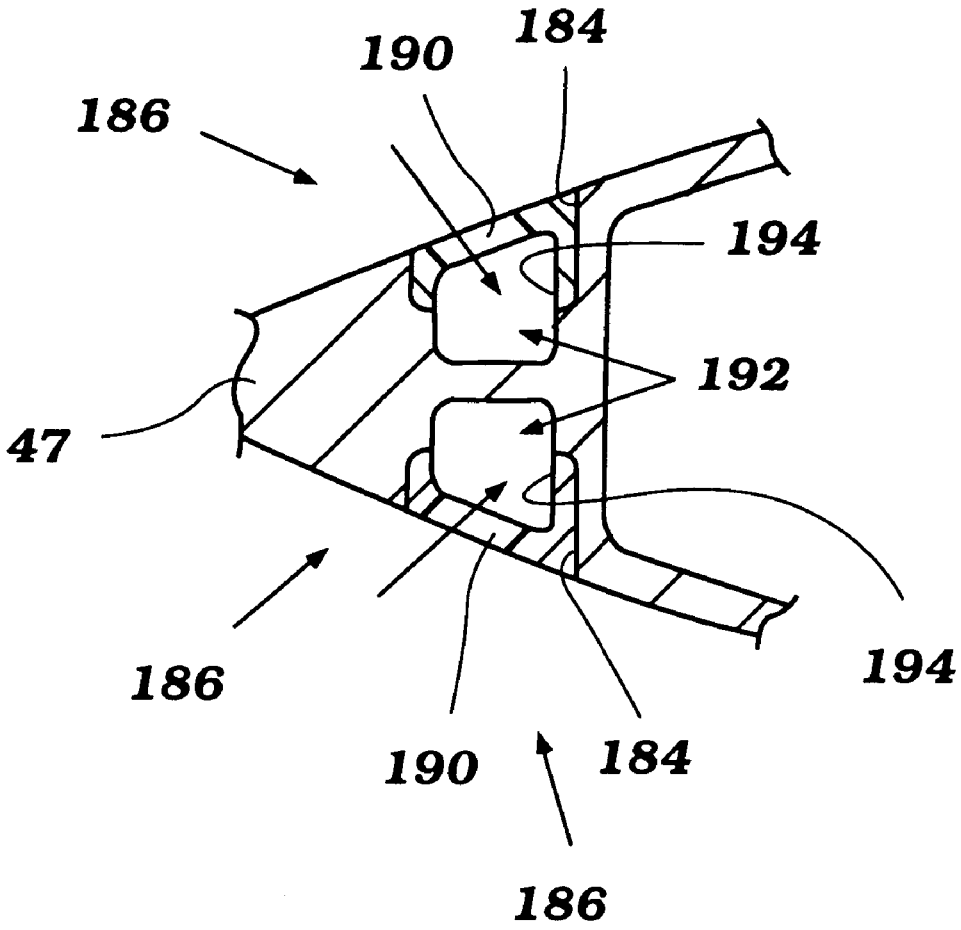
FIG. 4 is a top plan view of the lower unit of the outboard motor of FIG. 1 taken along the lines IV—IV in FIG. 2.
Figure 5:
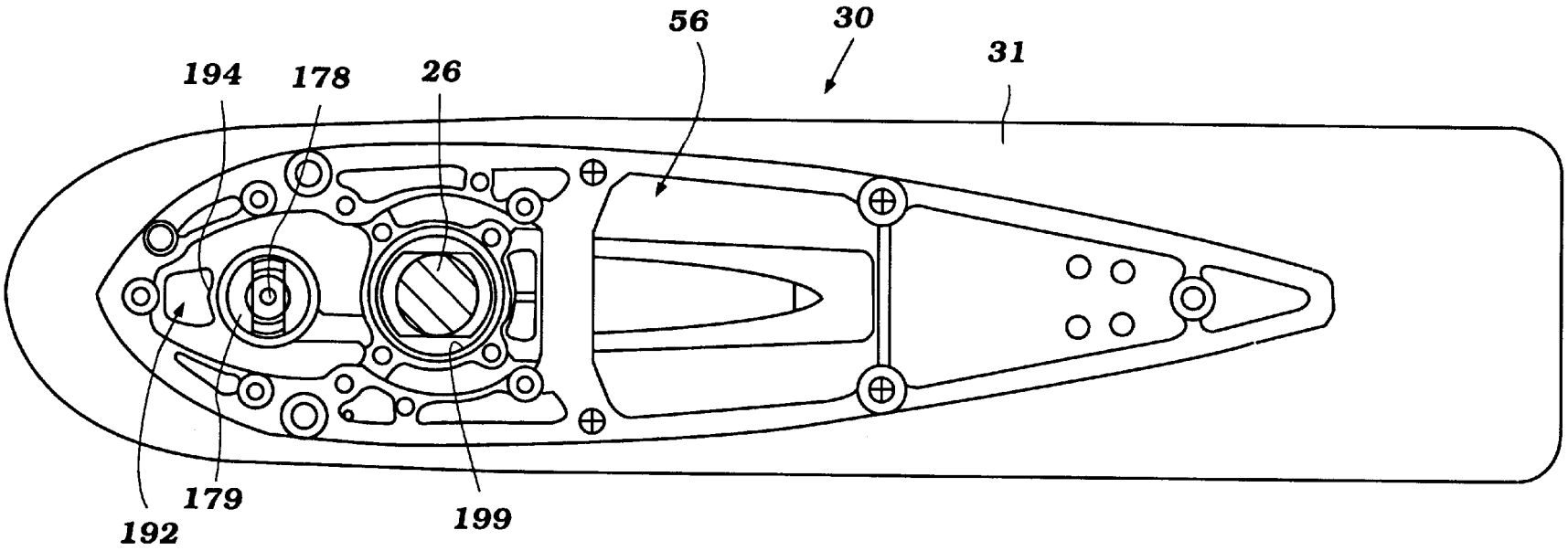
FIG. 5 is a top plan view of the lower unit of the outboard motor of FIG. 1.

With reference to FIGS. 2–4, a water inlet 183 is located on each side of the front end of the lower unit 30. Each water inlet 183 is defined by an opening 184 that extends through the lower unit 30. Desirably, each water inlet 183 is located on the sides of the nacelle 46 with a majority of the water inlet 183 openings, through which the water passage 192 receives water, lie closer to the propulsion shaft 64 than an uppermost point of the nacelle 46 and slightly above the longitudinal axis L of the propulsion shafts 53, forward of the transmission 45.

A cover 186 is positioned over each water inlet 183. As best seen in FIGS. 3 and 4, each cover 186 extends through each opening 184 so that an outer side of each lid is positioned flush with the outer surface of the nacelle 46. A plurality of openings 190 are located on each cover 186 for the passage of fluid therethrough. The plurality of openings 190 desirably extend through each cover 186 in a direction that is angled rearward.

As shown in FIGS. 3 and 4, each opening 184 extends through the nacelle 46 and communicates with a water passage 192 that extends upward through the lower unit 30. The cross-sectional flow area of the water passage at its influent end is greater than the total flow area of the water inlet openings 190. The water passage 192 desirably is positioned forward of the transmission 45 and the rotatable shift rod 178. At its lower end, the water passage 192 is separated from the transmission 45 and shift mechanism 49 by a wall 194. Hence, at its lower end, the water passage 192 is defined by the rear wall 194 and an opposite-facing front wall 196, as well 30 as two opposing side walls 197 and 198. The water passage expands upward above the transmission 45. As discussed, the shift rod 178 is housed within a sealed vertical chamber 179, thus separating the shift rod 178 from the water passage 192. A sealed housing 199 separates the drive shaft 26 from the water passage 192 within the lower unit 30.

With reference to FIGS. 2 and 3, a water passage lid 200 is mounted onto the upper end of the lower unit 30 and lies within the drive shaft housing 28, immediately above the junction between the drive shaft housing 28 and the lower unit 30. The water passage lid 200 consists of a generally horizontal planar portion 202 which is supported by walls 204 that extend downward therefrom and connect to the top end of the lower unit 30. The water passage lid 200 serves to define the water passage 192 at its upper end.

With reference to FIG. 2, the water passage 192 communicates with a water pump 208. The water pump 208 is located within the drive shaft housing 28 rearward of the water passage lid 200. Desirably, the water pump is located immediately above the junction where the drive shaft housing 28 meets the lower unit 30.

The water pump 208 communicates with a water tube 210 that is located rearward of the water pump 208. The water tube 210 is defined by a wall 212 that separates the water tube 210 from the discharge conduit 55. The water tube 210 extends upward through the drive shaft housing 28 and communicates with water jackets that extend through the engine 18.

With reference to FIG. 1, when the watercraft is in a body of water, the water level is desirably located along the line A as the watercraft is either accelerating or decelerating through the water, such that the propeller blades 62 and 70 are totally submerged. During high speed operation, the watercraft desirably planes with its bottom surface 15 riding over the water surface so that the water level is located along line B. During such high speed operation, the propellers are partially exposed above the water surface, so that only the lower blades (i.e., below the longitudinal axis L) remain submerged in water. In any event, the positioning of the water inlet 183 immediately above the propulsion shaft 53 provides the advantage that the water inlet 183 remains below the water level when the watercraft is riding planar and the propeller blades are partially surfaced.

As the watercraft travels through water, the relative velocity between the water and the nacelle 46 will urge water through the water inlet 183 by way of the plurality of openings 190 in the water inlet cover 186. As discussed, the plurality of openings 190 are angled rearward through the wall of the lower unit, thereby lessening resistance to the water as it passes through each water inlet 183.

The momentum of the water as it passes through the inlet 183 desirably will propel the water upward through the water passage 192, thus filling the water passage 192 with water. The water pump 208 also helps draw water into the water passage 192, especially at low speeds. The water pump 208 is located at a junction between the lower unit 30 and the drive shaft housing 28. The water pump 208 then pumps the water from the water passage 192 and into the water tube 210. The water tube 210 guides the water to the engine 18 for cooling. The method by which the water, once within the engine, cools the engine is considered to be conventional. For that reason, further description is not believed to be necessary for an appreciation or understanding of the present invention.

Figure 6:
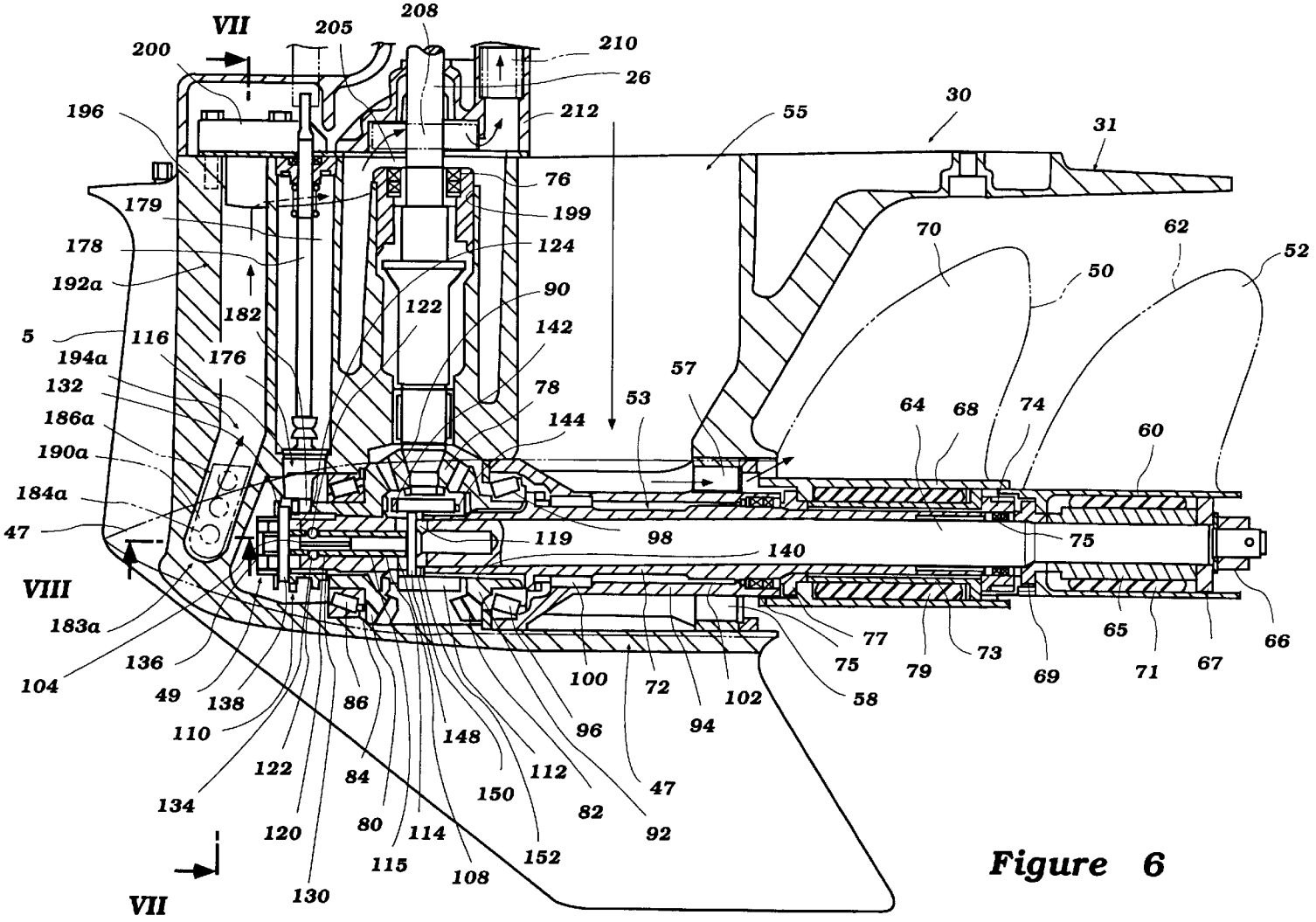
FIG. 6 is a sectional, side elevational view of a lower unit of an outboard motor illustrating another embodiment of the water cooling system, transmission and a propulsion device of the outboard motor which includes a propulsion shaft assembly.
Figure 7:
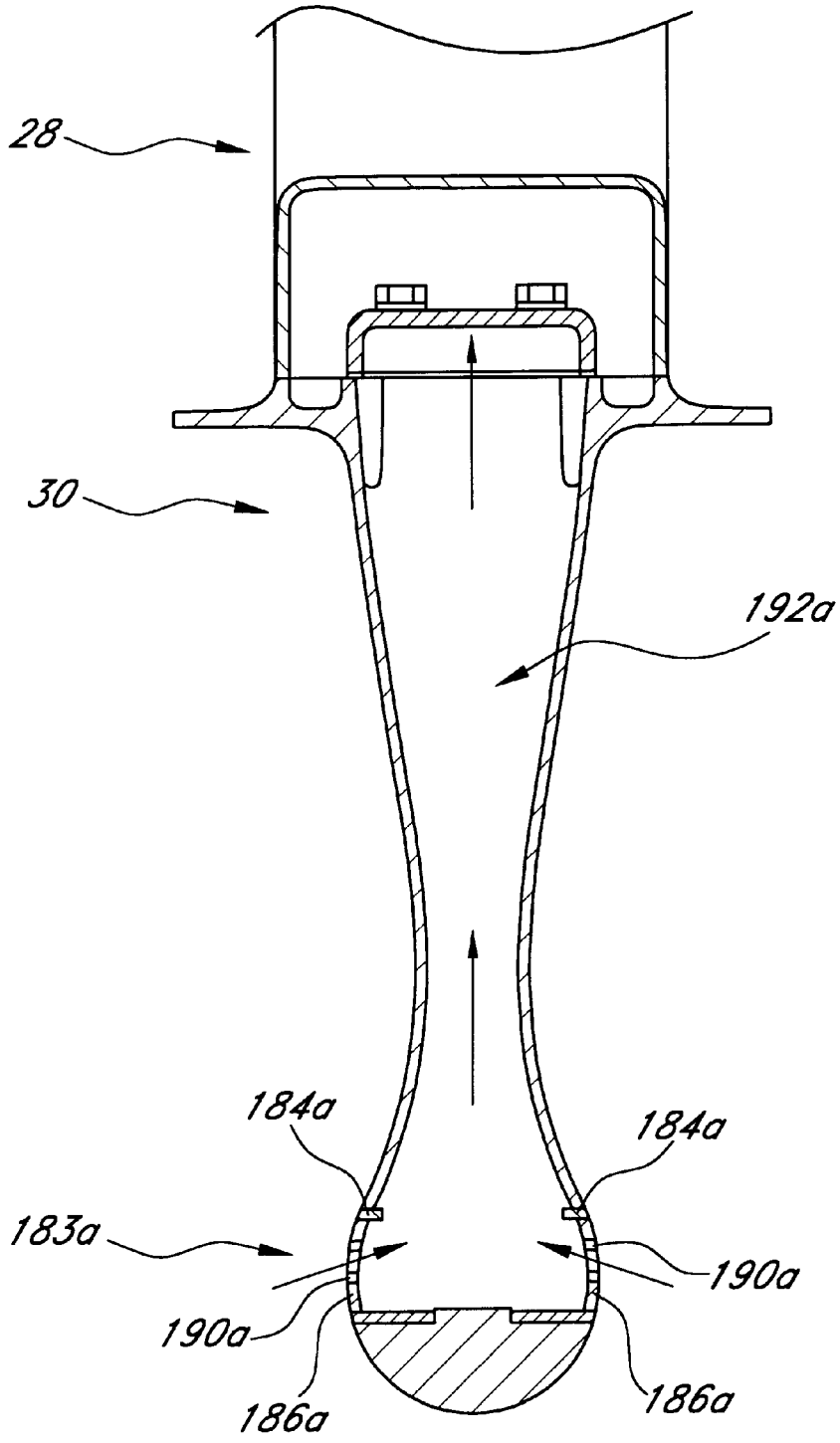
FIG. 7 is a front plan view of the lower unit of the outboard motor of FIG. 6 taken along the lines VII—VII in FIG. 6.
Figure 8:
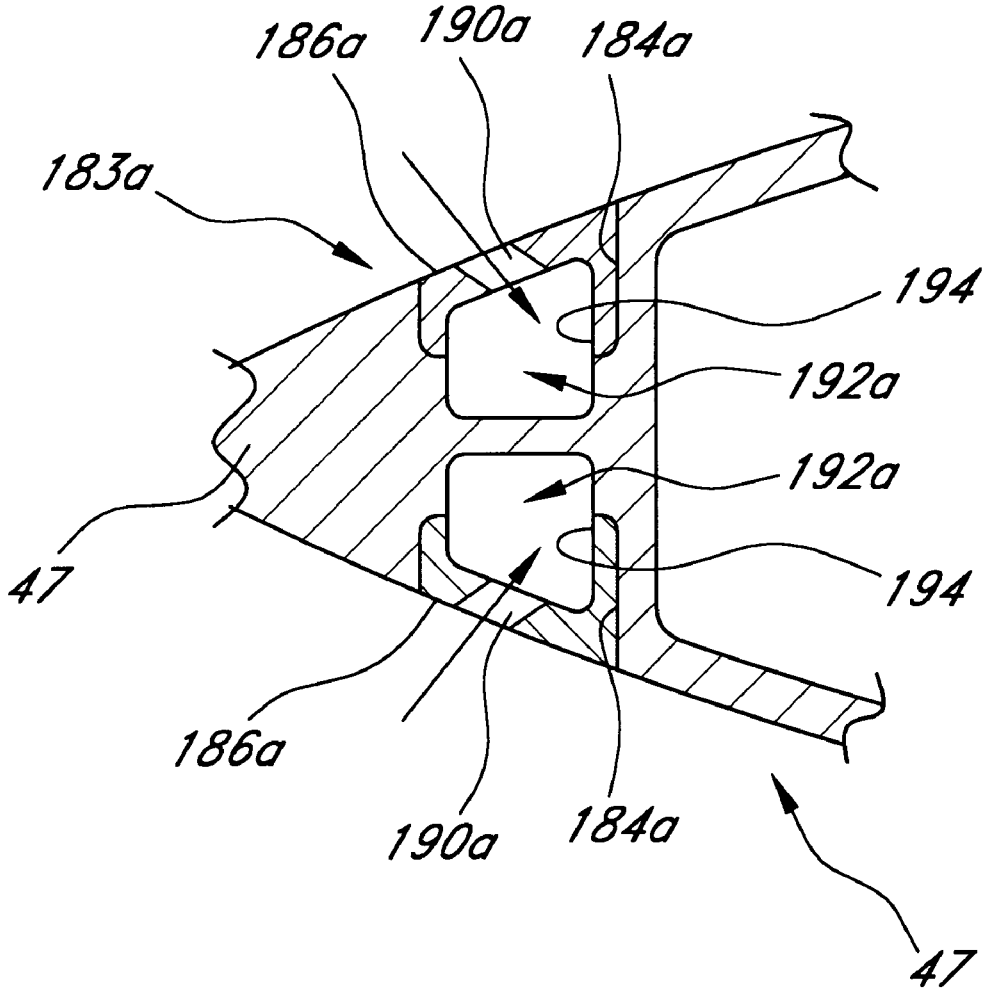
FIG. 8 is a top plan view of the lower unit of the outboard motor of FIG. 6 taken along the lines VIII—VIII in FIG. 6.
Figure 9:
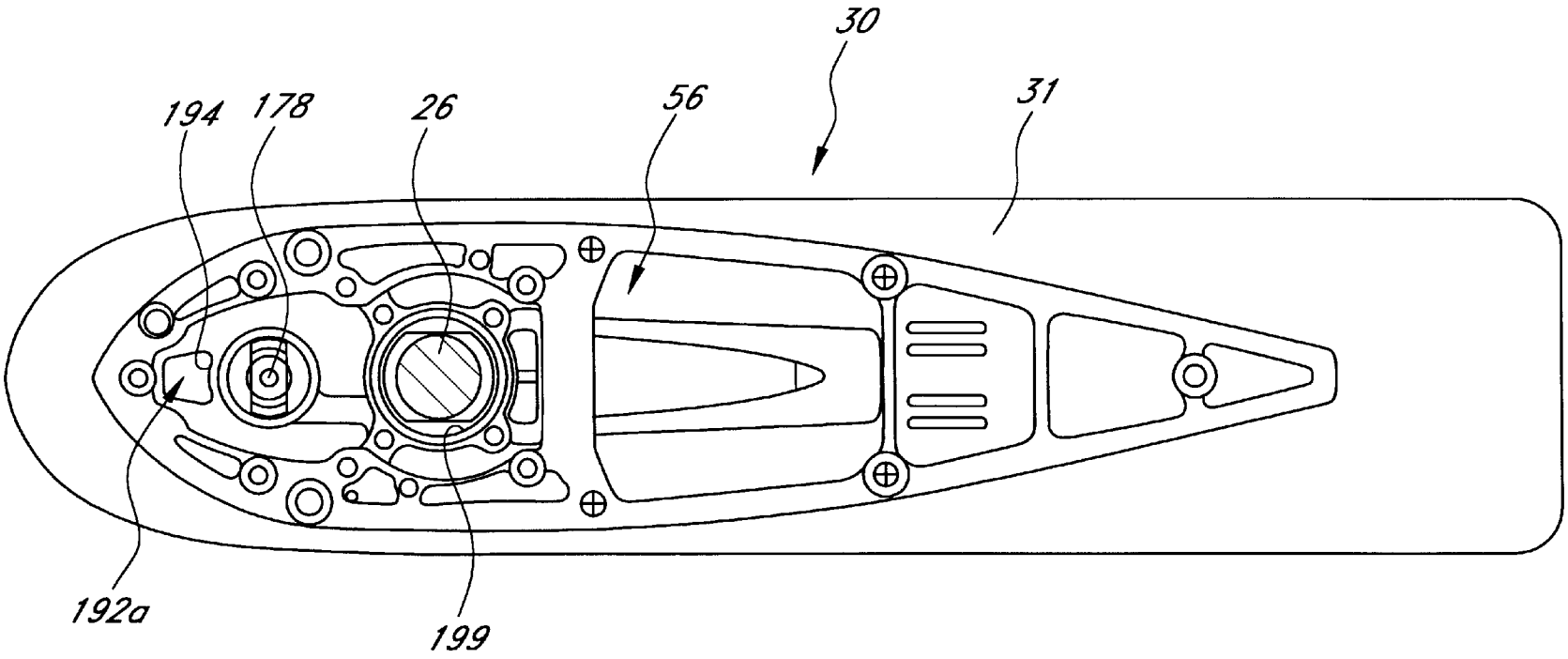
FIG. 9 is a top plan view of the lower unit of the outboard motor of FIG. 6.

FIGS. 6–9 illustrates another embodiment of the present water cooling system. This embodiment functions in the same manner as the embodiment described above. However, the shape of the water inlet differs in this embodiment. Where appropriate, like reference numerals with an "a" suffix have been used to indicate like parts of the two embodiments of the water cooling system for ease of understanding. Otherwise, the same reference numerals are used with the balance of the component of the outboard drive that are common to both embodiments As seen in FIG. 6, the water inlet 183*a* has an oblong shape that extends upward and rearward along the front portion of the lower unit 30, forward of the transmission. A cover 186*a* covers the water inlet 183*a*. In this embodiment, a series of circular openings 190*a* extend through the cover 186*a* for the passage of fluid therethrough. The water inlet communicates with a water passage 192*a*.

The lower portion of the water passage 192*a* angles upward and rearward through the lower unit 30. The angle of the water unit 192*a* desirably provides a reduced resistance to water as it travels through the water unit 192*a*. The water passage guides water to the water pump 208 for pumping to the engine, in the manner described above. casing 31 may be manufactured using a variety of techniques that are commonly known in the art. In addition, the casing 31 may be manufactured using a cast molding that utilizes a core, such as a sand mold casting.

As common to both embodiment, the water inlet passage, which leads to the water pump positioned over the transmission, is located on the front side of the lower unit, in front of the transmission and the shift rod. This position allows the passage to have an ample size to supply the pump with an adequate supply of water to cool the engine. This position also does not affect the size of the exhaust passage through the lower unit.

The water inlet also lies on the nose of the nacelle just behind the nacelle's tapered end. In this position, the water inlet remains submerged even when the watercraft is up on plane with the outboard motor's propellers partially exposed.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An outboard drive for a marine propulsion system which includes an engine, the outboard drive comprising an upper housing and a lower unit that includes a strut and a nacelle, the strut depending downward from the upper housing and the nacelle being attached to a lower end of the strut, the nacelle housing a transmission that is driven by a drive shaft coupled to the engine and is operated by a shift rod, the shift rod and the drive shaft extending through the strut of the lower unit and arranged therein such that the shift rod lies closer to the drive shaft than to a leading edge of the strut, the transmission selectively coupling the engine to a propulsion shaft of a propulsion device which the lower unit supports, a water pump located at a junction between the lower unit and the upper housing, and a water cooling system which supplies cooling water to the engine, the water cooling system including at least one water inlet having a plurality of openings that open into an influent end of a water passage that extends between the water inlet and the water pump, the water passage being positioned on the front side of the transmission.

2. An outboard drive as in claim 1, wherein the water passage for at least a majority of its length is disposed forward of the shift rod.

3. An outboard drive as in claim 1, wherein the water inlet is located directly forward of the transmission.

4. An outboard drive as in claim 3, wherein the lower unit includes a plurality of water inlets which are disposed on both sides of the lower unit behind a leading edge of the lower unit.

5. An outboard drive as in 4, wherein the lower unit tapers toward its leading end.

6. An outboard drive as in claim 3, wherein the cross-sectional flow area of the water passage influent end is greater than the total flow area of the water inlet openings and the cross sectional flow area of the water passage increases toward an upper end of the water passage where the water pump lies.

7. An outboard drive as in claim 6, wherein a removable lid encloses an upper end of the water passage within the lower unit.

8. An outboard drive as in claim 1, wherein the nacelle is positioned on the lower unit in a position where the nacelle is submerged in the body of water in which the outboard drive is operated when the watercraft is idling, and is in contact with the water when the watercraft is planing.

9. An outboard drive as in claim 1, wherein a nose of the nacelle is generally cone-shaped with a rounded tip.

10. An outboard drive as in claim 1, wherein the lower unit is located beneath the engine of the marine propulsion system.

11. An outboard drive as in claim 1, wherein the water cooling system includes a cover which has a plurality of openings, the cover is positioned over the water inlet.

12. An outboard drive as in claim 1, wherein the transmission is intended to selectively change the coupling between the propulsion device to the engine such that the propulsion device operates in a forward direction, a neutral condition or a reverse direction.

13. An outboard drive as in claim 1, wherein at least a majority of the water inlet openings, through which the water passage receives water, lie closer to the propulsion shaft than does an uppermost point of the nacelle.

14. An outboard drive coupled with an engine, the outboard drive comprising a lower casing including a nacelle, said nacelle having a bullet-shaped nose and housing a transmission and first and second coaxial propulsion shafts that rotate about a common longitudinal axis to drive a propulsion device including counter-rotating, propellers, the propulsion shaft being arranged within the nacelle such that a centerline of the nacelle lies parallel to the longitudinal axis, and at least one water inlet of a water cooling system being located on the nose of the nacelle immediately above the longitudinal axis of the propulsion shaft, the transmission comprising first and second counter-rotating gears, a first clutch element coupled to the first propulsion shaft on a side of the first and second gears near the water inlet, and a second clutch element coupled to the second propulsion shaft and interposed between said first and second gears.

15. An outboard drive as in claim 14, wherein the water inlet is located forward of the transmission.

16. An outboard drive as in claim 14, wherein the shape of the water inlet slopes upwardly in a rearward direction.

17. An outboard drive as in claim 14, wherein at least a majority of the water inlet openings lie closer to the propulsion shaft than does an uppermost point of the nacelle.

18. A watercraft equipped with an engine coupled to an outboard drive, the outboard drive comprising an upper housing and a lower unit that includes a strut and a nacelle, the strut depending downward from the upper housing and the nacelle being attached to a lower end of the strut, the nacelle housing a transmission that is driven by a drive shaft coupled to the engine and is operated by a shift rod, the shift rod and the drive shaft extending through the strut of the lower unit and arranged therein such that the shift rod lies closer to the drive shaft than to a leading edge of the strut, the transmission selectively coupling the engine to a propulsion shaft of a propulsion device which the lower unit supports, a water pump located at a junction between the lower unit and the upper housing, the watercraft having a hull with a bottom surface and a transom, the lower unit supporting a propulsion device at a rear end of the lower unit, the outboard drive being mounted on the transom in a position relative to the bottom surface where the propulsion device is intended to operate at least partially exposed above the surface of the body of water in which the watercraft is operated when the watercraft is up on plane, the outboard drive including at least one water inlet for a water cooling system that supplies cooling water to the engine, the water inlet having a plurality of openings that opens into an influent end of a water passage that extends between the water inlet and the water pump, the water passage being positioned on the front side of the transmission, at least a majority of the water inlet openings, through which the water passage receives water, lie closer to the propulsion shaft than an uppermost point of the nacelle.

19. A watercraft as in claim 18, wherein the nacelle has a tapered nose, and the water inlet openings are disposed on at least one side of the lower unit behind a leasing edge of the lower unit.

20. The watercraft as in claim 17, wherein the water inlet openings are positioned forward of the transmission.

21. A watercraft as in claim 20, wherein the water passage extends between the water inlet and the water pump.

22. A watercraft as in claim 21, wherein the cross-sectional flow area of the water passage influent end is greater than the total flow area of the water inlet openings and the water passage increases in size toward the water pump.

* * * * *

UNITED STATES PATENT AND TRADEMARK OFFICE

CERTIFICATE OF CORRECTION

PATENT NO. : 6,022,251
DATED : February 8, 2000
INVENTOR(S) : Hiroshi Ogino

It is certified that error appears in the above-identified patent and that said Letters Patent is hereby corrected as shown below:

Column 14,

Claim 17,
Line 19, "wherein at least" should be -- wherein the water inlet is formed by a plurality of water inlet openings, and at least --.

Claim 19,
Line 54, 'a leasing edge" should be -- a leading edge --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*